US008808953B2

(12) United States Patent
Sugiura et al.

(10) Patent No.: US 8,808,953 B2
(45) Date of Patent: Aug. 19, 2014

(54) ELECTROPHOTOGRAPHIC PHOTORECEPTOR, PROCESS CARTRIDGE, AND IMAGE FORMING APPARATUS

(75) Inventors: Satoya Sugiura, Kanagawa (JP); Shigeto Hashiba, Kanagawa (JP); Kazuhiro Koseki, Kanagawa (JP); Hirofumi Nakamura, Kanagawa (JP); Kenta Ide, Kanagawa (JP); Akihiro Nonaka, Kanagawa (JP); Kosuke Narita, Kanagawa (JP); Akihiro Kawasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 11 days.

(21) Appl. No.: 13/561,535

(22) Filed: Jul. 30, 2012

(65) Prior Publication Data

US 2013/0252147 A1 Sep. 26, 2013

(30) Foreign Application Priority Data

Mar. 23, 2012 (JP) ..... 2012-068293

(51) Int. Cl.
*G03G 5/14* (2006.01)

(52) U.S. Cl.
CPC ..... *G03G 5/144* (2013.01); *G03G 5/142* (2013.01)
USPC ..... 430/59.4; 430/60; 430/63; 430/65; 430/133; 430/134; 430/59.6; 430/58.85

(58) Field of Classification Search
CPC ..... G03G 5/142; G03G 5/144
USPC ..... 430/58.85, 59.6, 60, 65, 63, 133, 134; 399/159
See application file for complete search history.

(56) References Cited

U.S. PATENT DOCUMENTS

| | | | | |
|---|---|---|---|---|
| 5,008,706 | A * | 4/1991 | Ohmori et al. | 399/174 |
| 2006/0014091 | A1* | 1/2006 | Nukada et al. | 430/60 |
| 2009/0010664 | A1* | 1/2009 | Nukada et al. | 399/49 |
| 2009/0325096 | A1* | 12/2009 | Wu | 430/58.85 |

FOREIGN PATENT DOCUMENTS

| | | | |
|---|---|---|---|
| JP | 11174696 A | * | 7/1999 |
| JP | A-2005-62521 | | 3/2005 |
| JP | A-2006-195041 | | 7/2006 |
| JP | 2006259141 A | * | 9/2006 |
| JP | 2008046420 A | * | 2/2008 |

OTHER PUBLICATIONS

English language machine translation of JP 11-174696 (Jul. 1999).*

* cited by examiner

*Primary Examiner* — Christopher Rodee
(74) *Attorney, Agent, or Firm* — Oliff PLC

(57) ABSTRACT

An electrophotographic photoreceptor includes a conductive support, and an undercoat layer, a charge generation layer, and a charge transport layer that are provided in this order on the conductive support, wherein the undercoat layer includes at least metallic oxide particles, a reactive acceptor substance including an anthraquinone structure expressed by the following Formula 1, and a binder resin, the charge generation layer includes hydroxygallium phthalocyanine as a charge generation material, and a reflectance of incident light having a wavelength of 780 nm on a surface of the charge generation layer when the charge transport layer is removed is 17% or greater:

Formula 1 wherein the anthraquinone structure expressed by Formula 1 is bonded to another structure at a position of *, and thus forms the reactive acceptor substance, and in Formula 1, n1 represents an integer of 1 to 7.

14 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-068293 filed Mar. 23, 2012.

BACKGROUND

1. Technical Field

The present invention relates to an electrophotographic photoreceptor, a process cartridge, and an image forming apparatus.

2. Related Art

Since electrophotographic image formation has advantages of high speed and high printing quality, it is widely used in fields such as copiers and laser-beam printers. Generally, Carlson's method is used in image forming apparatuses such as copiers and laser-beam printers. An electrostatic latent image formed on an electrophotographic photoreceptor using charging by a corona charging unit or a conductive roller and using an exposure device is developed in a developing process, and then is transferred onto a recording medium such as a recording sheet in a transfer process. Next, in a fixing process, fixing to the recording medium such as a recording sheet by heat and pressure is performed to form an image.

As the electrophotographic photoreceptor (hereinafter, may be simply referred to as "photoreceptor") for use in the electrophotographic apparatus, electrophotographic photoreceptors using an organic photoconductive material having excellent advantages in view of inexpensiveness, manufacturability, and disposability are much more common in comparison with photoreceptors using an inorganic photoconductive material. Among them, functional separation-type organic photoreceptors in which a charge generation layer that generates charges by exposure and a charge transport layer that transports charges are laminated are excellent in view of electrophotographic characteristics, and various proposals have been made and put to practical use. In recent years, with the development of techniques, speed, image quality, and lifetime have increased.

Regarding an undercoat layer, in order to suppress the generation of residual potential with a bulk deterioration due to energization history and a deterioration of an interface between the undercoat layer and a conductive base material, a configuration in which the undercoat layer contains an acceptor is well known. In addition, by increasing the amount of the acceptor, the generation of residual potential may be suppressed over a longer period of time.

SUMMARY

According to an aspect of the invention, there is provided an electrophotographic photoreceptor including: a conductive support; and an undercoat layer, a charge generation layer, and a charge transport layer that are provided in this order on the conductive support, wherein the undercoat layer includes at least metallic oxide particles, a reactive acceptor substance including an anthraquinone structure expressed by the following Formula 1, and a binder resin, the charge generation layer includes hydroxygallium phthalocyanine as a charge generation material, and a reflectance of incident light having a wavelength of 780 nm on a surface of the charge generation layer when the charge transport layer is removed is 17% or greater.

Formula 1

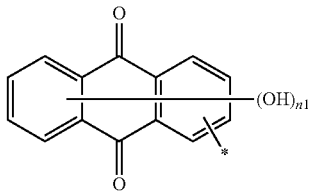

The anthraquinone structure expressed by Formula 1 is bonded to another structure at a position of *, and thus forms the reactive acceptor substance.

In Formula 1, n1 represents an integer of from 1 to 7.

BRIEF DESCRIPTION OF THE DRAWINGS

Exemplary embodiments of the present invention will be described in detail based on the following figures, wherein.

DETAILED DESCRIPTION

Figure 1:
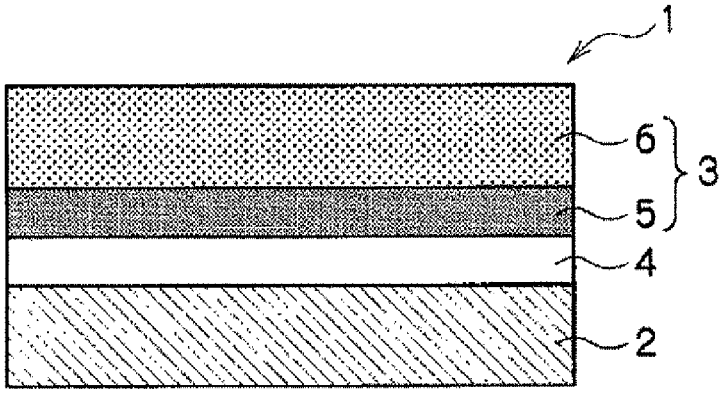
FIG. 1 is a schematic diagram showing a cross-section of a part of an electrophotographic photoreceptor of an exemplary embodiment.

Hereinafter, an electrophotographic photoreceptor, a process cartridge, and an image forming apparatus according to an exemplary embodiment of the invention will be described in detail.

Electrophotographic Photoreceptor

An electrophotographic photoreceptor of this exemplary embodiment is a photoreceptor including a conductive support, and an undercoat layer, a charge generation layer, and a charge transport layer that are provided in this order on the conductive support, in which the undercoat layer includes at least metallic oxide particles, a reactive acceptor substance including an anthraquinone structure expressed by the following Formula 1, and a binder resin, the charge generation layer includes hydroxygallium phthalocyanine as a charge generation material, and the reflectance of incident light having a wavelength of 780 nm on a surface of the charge generation layer when the charge transport layer is removed is 17% or greater, preferably 20% or greater.

Formula 1

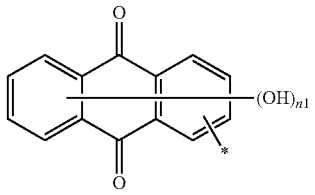

The anthraquinone structure expressed by Formula 1 is bonded to another structure at a position of *, and thus forms the reactive acceptor substance. The another structure bonded at the position of * is preferably an alkoxy group, and more preferably an alkoxy group having from 1 to 8 carbon atoms.

In Formula 1, n1 represents an integer of 1 to 7.

As described above, in order to suppress the generation of residual potential with a bulk deterioration due to energisation history and a deterioration of an interface between the undercoat layer and a conductive base material, a configuration in which the undercoat layer contains an acceptor is well known. However when lifetime is improved by increasing the amount of the acceptor substance of the undercoat layer, the energy barrier at the interface between the undercoat layer and the charge generation layer is reduced, and thus, in some cases, the carriers accumulated at the interface pass through the charge generation layer and the charge transport layer and easily reach the outermost surface. That is, the carriers accumulated at the interface between the undercoat layer and the charge generation layer distort the interior electric field and locally form a high electric field, whereby a hole-blocking property is reduced at the time of charging in the next cycle. This leads to a reduction in potential of a charging portion, and in some cases, so-called ghosting is generated so that in the image forming history portion of the previous cycle, the image density is reduced in the next cycle. Particularly, in a high-speed mechanism in which an elapsed time between the exposure and the next charging and an elapsed time between the erasing and the next charging are reduced for high productivity, release of the accumulated carriers having low mobility is not easy, whereby in some cases, the above problem is manifested in image quality.

In the case of the electrophotographic photoreceptor of this exemplary embodiment, the image forming history of the previous cycle does not easily remain in the next cycle. As a result, generation of ghosting is suppressed. The reason that when an electrophotographic photoreceptor has the configuration of this exemplary embodiment, image forming history does not easily remain in the next cycle is not clear, but it may be as follows.

The reason for this is speculated to be because the energy barrier at the interface between the undercoat layer and the charge generation layer increases by using the configuration of this exemplary embodiment in the undercoat layer, and thus even when the carriers accumulated at the interface distort the interior electric field, the hole-blocking property may be sufficiently maintained.

The electrophotographic photoreceptor of this exemplary embodiment has a conductive support, and an undercoat layer, a charge generation layer, and a charge transport layer that are provided in this order on the conductive support, and may also have an intermediate layer and the like as necessary. Hereinafter, the electrophotographic photoreceptor of this exemplary embodiment will be described on the basis of the drawings.

FIG. 1 schematically shows a cross-section of a part of the electrophotographic photoreceptor of this exemplary embodiment. An electrophotographic photoreceptor 1 shown in FIG. 1 is provided with a functional separation-type photosensitive layer 3 in which a charge generation layer 5 and a charge transport layer 6 are separately provided, and has a structure in which on a conductive support 2, an undercoat layer 4, the charge generation layer 5, and the charge transport layer 6 are laminated in this order.

In this exemplary embodiment, an insulation property means a range greater than or equal to $10^{12}$ Ω·cm in terms of volume resistivity. A conductive property means a range less than or equal to $10^{10}$ Ω·cm in terms of volume resistivity.

Hereinafter, the respective elements of the electrophotographic photoreceptor 1 will be described.

Conductive Support

As the conductive support 2, any support may be used if it has been used in the related art. Examples thereof include metals such as aluminum, nickel, chromium, and stainless steel, plastic films provided with a thin film of aluminum, titanium, nickel, chromium, stainless steel, gold, vanadium, tin oxide, indium oxide, and ITO, and paper and plastic films coated or impregnated with a conductivity imparting agent.

The shape of the conductive support 2 is not limited to a drum shape, and may be a sheet shape or a plate shape.

When a metallic pipe is used as the conductive support 2, the surface thereof may be used as it is, or may be subjected to specular machining, etching, anodization, coarse machining, centerless grinding, sand blasting, wet honing, or the like in advance.

Undercoat Layer

The undercoat layer 4 is provided with the aim of preventing light reflection on the surface of the conductive support 2, preventing unnecessary carriers from flowing from the conductive support 2 to the photosensitive layer 3, and the like.

The undercoat layer 4 includes at least metallic oxide particles, a reactive acceptor substance (hereinafter, may be referred to as a specific acceptor substance) including an anthraquinone structure expressed by the following Formula 1, and a binder resin.

In this exemplary embodiment, the reactive acceptor substance is a material that chemically reacts with the surfaces of the metallic oxide particles contained in the undercoat layer 4, or a material that is adsorbed to the surfaces of the metallic oxide particles, and may be selectively present on the surfaces of the metallic oxide particles.

Formula 1

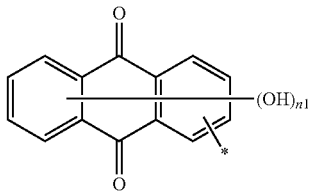

The anthraquinone structure expressed by Formula 1 is bonded to another structure at a position of *, and thus forms the reactive acceptor substance. As examples of another structure, one atom such as a hydrogen atom is also included other than structures formed of plural atoms.

In Formula 1, n1 represents an integer of from 1 to 7, and is preferably an integer of from 1 to 4.

Hereinafter, specific examples of the reactive acceptor substance including the anthraquinone structure expressed by Formula 1 will be shown, but this exemplary embodiment is not limited to the following specific examples.

1-1

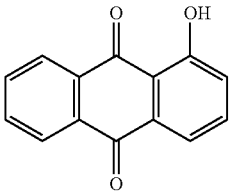

1-2

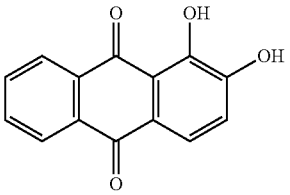

1-3

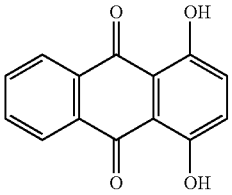

1-4

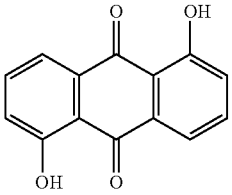

1-5

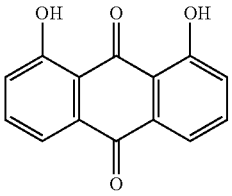

1-6

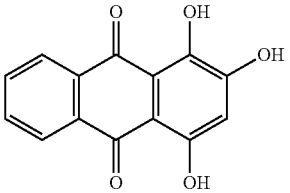

1-7

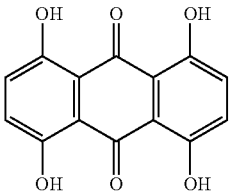

1-8

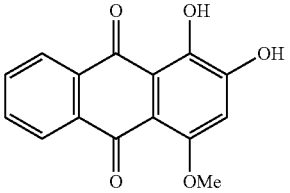

-continued 1-9

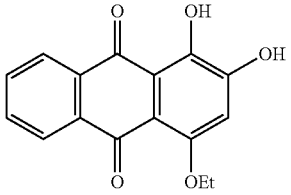

1-10

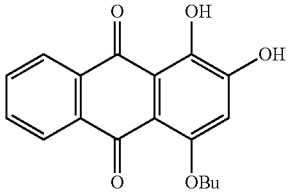

1-11

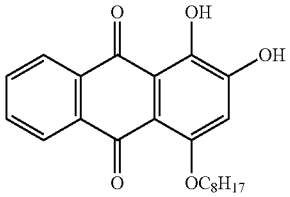

1-12

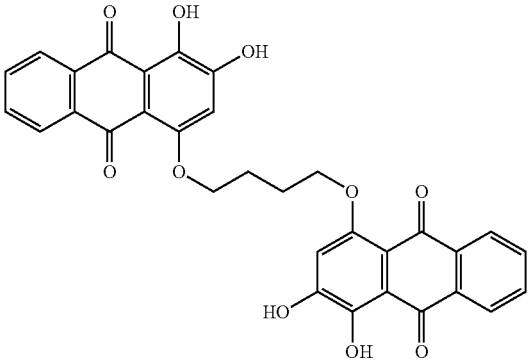

1-13

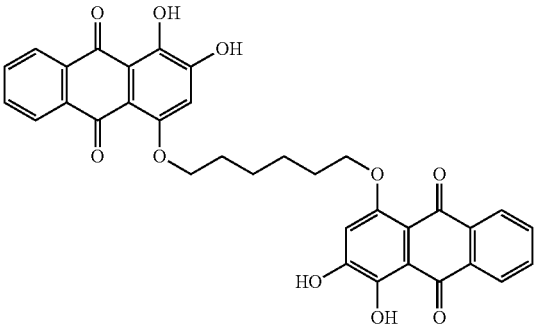

In this exemplary embodiment, other acceptor substances may be used in combination with the specific acceptor substance. Examples of other acceptor substances include quinones, coumarins, phthalocyanines, triphenylmethanes, anthocyanins, flavones, fullerenes, ruthenium complexes, xanthenes, benzoxazines, and porphyrins.

When other acceptor substances are used in combination, the proportion of the specific acceptor substance in the total amount of the acceptor substances is preferably 50% by weight or greater, and more preferably 75% by weight or greater.

The amount of the reactive acceptor substance added is determined in consideration of the surface area of the metallic oxide particles that chemically react with the reactive acceptor substance or to which the reactive acceptor substance is adsorbed, the electron transport abilities of the respective materials, and the content of the metallic oxide particles. However, generally, the reactive acceptor substance is used in an amount of 0.1% by weight to 10% by weight with respect to the total solid content in the undercoat layer. More preferably, the reactive acceptor substance is used in an amount of 0.5% by weight to 5% by weight. When the amount of the reactive acceptor substance added is less than 0.1% by weight, the effect of the acceptor substance may not be easily exhibited. On the other hand, when the amount of the reactive acceptor substance added is greater than 10% by weight, the metallic oxide particles easily aggregate with each other, unevenness easily occurs in the distribution of the metallic oxide particles in the undercoat layer, and an excellent conducting path is not easily formed. Therefore, the residual potential may be increased, black dots may be generated, and unevenness may occur in the half-tone density.

In this exemplary embodiment, as the metallic oxide particles, a conductive powder having a particle diameter of preferably 100 nm or less, and particularly 10 nm to 100 nm is preferably used. Here, the particle diameter means an average primary particle diameter. The average primary particle diameter of the metallic oxide particles is a value that is observed and measured using a scanning electron microscope (SEM).

When the particle diameter of the metallic oxide particles is less than 10 nm, the surface area of the metallic oxide particles increases, and uniformity of the dispersion may be reduced. On the other hand, when the particle diameter of the metallic oxide particles is greater than 100 nm, secondary or higher-order particles are anticipated to have a particle diameter of approximately 1 μm, and thus a part in which the metallic oxide particles are present in the undercoat layer and a part in which no metallic oxide particles are present in the undercoat layer, that is, a so-called sea-island structure is easily formed, and image quality defects such as unevenness in the half-tone density may be generated.

It is necessary for the undercoat layer 2 to obtain appropriate impedance at a frequency corresponding to the electrophotographic process speed. Therefore, the metallic oxide particles preferably have a powder resistance of approximately $10^4$ Ω·cm to $10^{10}$ Ω·cm. Metallic oxide particles such as tin oxide, titanium oxide, and zinc oxide having the above resistance value are preferably used, and zinc oxide is more preferably used. When the resistance value of the metallic oxide particles is less than $10^4$ Ω·cm, the inclination of dependence of the impedance on the amount of the particles added is too large, and the impedance may not be easily controlled. On the other hand, when the resistance value of the metallic oxide particles is greater than $10^{10}$ Ω·cm, the residual potential increases in some cases.

The metallic oxide particles are preferably coated with at least one type of a coupling agent as necessary in order to improve characteristics such as dispersibility. The coupling agent is preferably at least one type selected from a silane coupling agent, a titanate coupling agent, and an aluminate coupling agent.

Specific examples of the coupling agent include, but are not limited to, silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, aluminate coupling agents such as acetoalkoxyaluminum diisopropylate, and titanate coupling agents such as isopropyl triisostearoyl titanate, bis(dioctyl pyrophosphate), and isopropyl tri(N-aminoethyl-aminoethyl)titanate. In addition, these coupling agents may be used as a mixture of two or more types thereof.

If necessary, in order to improve environmental dependence of the resistance value and the like, these metallic oxide particles may be heat-treated after the surfaces thereof are treated with the above-described coupling agent. The heat treatment temperature is preferably 150° C. to 300° C., and the treatment time is preferably 30 minutes to 5 hours.

The content of the metallic oxide particles in the undercoat layer 2 is preferably 30% by weight to 60% by weight, and more preferably 35% by weight to 55% by weight from the viewpoint of maintaining the electric characteristics.

As a method of dispersing the metallic oxide particles, known dispersing methods are used. Examples thereof include methods using a roll mill, a ball mill, a vibrating ball mill, an attritor, a sand mill, a colloid mill, and a paint shaker.

As the binder resin used in this exemplary embodiment, polymer resin compounds and the like are used. Examples thereof include an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, and a melamine resin.

A material in which the metallic oxide particles are mixed or dispersed in advance is dispersed in the binder resin to obtain a coating liquid for undercoat layer formation.

As a solvent that is used to obtain the coating liquid for undercoat layer formation, known organic solvents that dissolve the above-described binder resin, such as alcohols, aromatic compounds, halogenated hydrocarbons, ketones, ketone alcohols, ethers, and esters, are used. These solvents may be used singly or in a mixture of two or more types thereof.

When using coherent light such as a laser in an exposure device, it is necessary to prevent the generation of a moire image. For this, the surface roughness of the undercoat layer is adjusted to ¼n (n is a refractive index of the upper layer) to ½λ of a wavelength λ of a laser for exposure that is used. The surface roughness may be adjusted by adding resin balls into the undercoat layer. As the resin balls, a silicone resin, a cross-linked PMMA resin, and the like are used.

As an undercoat layer coating method, known coating methods such as a dipping coating method, a blade coating method, a wire bar coating method, a spray coating method, a bead coating method, an air knife coating method, and a curtain coating method are used.

The thickness of the undercoat layer is preferably 15 μm or greater, more preferably 15 μm to 30 μm, and even more preferably 20 μm to 25 μm from the viewpoint of preventing leakage due to a foreign substance.

The Vicker's strength of the undercoat layer is preferably 35 to 50.

If necessary, an intermediate layer may be provided between the undercoat layer and the photosensitive layer in order to improve the electric characteristics, image quality, image quality maintainability, photosensitive layer adhesiveness, and the like.

Examples of the material of the intermediate layer include polymer resin compounds such as an acetal resin such as polyvinyl butyral, a polyvinyl alcohol resin, casein, a polyimide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin; and organometallic compounds containing zirconium, titanium, aluminum, manganese, silicon atoms, and the like.

These compounds may be used singly or as a mixture or polycondensate of plural compounds. Among them, a zirconium- or silicon-containing organometallic compound is excellent in various properties. For example, the residual potential is small, and a variation in potential caused by the environment and a variation in potential caused by repeated use are small.

Examples of the silicon compound include vinyltrimethoxysilane, vinyltriethoxysilane, vinyltris(2-methoxyethoxysilane), γ-methacryloxypropyltrimethoxysilane, γ-glycidoxypropyltrimethoxysilane, γ-methacryloxypropyl-tris(β-methoxyethoxy)silane, β-(3,4-epoxycyclohexyl) ethyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, N-phenyl-3-aminopropyltrimethoxysilane, and γ-chloropropyltrimethoxysilane. Examples of the silicon compound that is particularly preferably used include silane coupling agents such as vinyltriethoxysilane, vinyltris(2-methoxyethoxysilane), γ-methacryloxypropyltrimethoxysilane, γ-glycidoxypropyltrimethoxysilane, β-(3,4-epoxycyclohexyl)ethyltrimethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, and γ-chloropropyltrimethoxysilane.

Examples of the organic zirconium compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the organic titanium compound include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate.

Examples of the organic aluminum compound include aluminum isopropylate, monobutoxy aluminum diisopropylate, aluminum butylate, diethylacetoacetate aluminum diisopropylate, and aluminum tris(ethylacetoacetate).

In addition, as a coating method that is used when providing the intermediate layer, normal methods such as a blade coating method, a wire bar coating method, a spray coating method, a dipping coating method, a bead coating method, an air knife coating method, and a curtain coating method are used.

The intermediate layer is used to perform a role as an electric blocking layer other than to improve the wettability of the upper layer. However, when the thickness thereof is too large, the electric barrier becomes too strong, whereby an increase in potential due to desensitization and repetition may occur. Accordingly, when the intermediate layer is formed, the thickness thereof is preferably set to 0.1 μm to 3 μm.

Charge Generation Layer

The charge generation layer 5 includes hydroxygallium phthalocyanine as a charge generation material. The charge generation layer 5 is formed through vacuum deposition of hydroxygallium phthalocyanine which is a charge generation material, or through application of a dispersion in which the charge generation material is dispersed with an organic solvent, a binder resin, an additive, and the like.

In this embodiment, as the charge generation material, hydroxygallium phthalocyanine is used from the viewpoint of a high charge generation efficiency for high speed and high image quality.

Particularly, examples of the hydroxygallium phthalocyanine include a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-rays.

In this exemplary embodiment, other charge generation materials other than hydroxygallium phthalocyanine may be used in combination with hydroxygallium phthalocyanine. Examples of other charge generation materials include phthalocyanine pigments such as metal-free phthalocyanine, chlorogallium phthalocyanine, dichlorotin phthalocyanine, and titanyl phthalocyanine. Examples of the phthalocyanine pigments include a chlorogallium phthalocyanine crystal having strong diffraction peaks at least at Bragg angles (2θ±0.2°) of 7.4°, 16.6°, 25.5°, and 28.3° with respect to CuKα characteristic X-rays, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-rays, a titanyl phthalocyanine crystal having strong diffraction peaks at least at Bragg angles (2θ±0.2°) of 9.6°, 24.1°, and 27.2° with respect to CuKα characteristic X-rays, and a titanyl phthalocyanine crystal having strong diffraction peaks at least at Bragg angles (2θ±0.2°) of 7.6°, 18.3°, 23.2°, 24.2°, and 27.3° with respect to CuKα characteristic X-rays. In addition, quinone pigments, perylene pigments, indigo pigments, bisbenzimidazole pigments, anthrone pigments, quinacridone pigments, and the like may be used. These other charge generation materials may be used singly or in a mixture of two or more types thereof.

When other charge generation materials are used in combination, the proportion of hydroxygallium phthalocyanine in the total amount of the charge generation materials is preferably 50% by weight or greater, and more preferably 70% by weight or greater.

The charge generation material used in this exemplary embodiment is manufactured by, for example, mechanical dry pulverization of a pigment crystal manufactured using a known method with an automatic mortar, a planetary mill, a vibrating mill, a CF mill, a roller mill, a sand mill, a kneader, or the like, and by wet pulverization of the material obtained by the dry pulverization using a solvent with a ball mill, a mortar, a sand mill, a kneader, or the like. Examples of the solvent used in the above process include aromatic compounds (toluene and chlorobenzene), amides (dimethylformamide and N-methylpyrrolidone), aliphatic alcohols (methanol, ethanol, and butanol), aliphatic polyhydric alcohols (ethylene glycol, glycerin, and polyethylene glycol), aromatic alcohols (benzyl alcohol and phenethyl alcohol), esters (acetic ester and butyl acetate), ketones (acetone and methyl ethyl ketone), dimethylsulfoxide, and ethers (diethyl ether and tetrahydrofuran). Furthermore, mixtures thereof and mixtures of these organic solvents with water are also included.

The solvent is used in an amount of 1 part to 200 parts, and preferably 10 parts to 100 parts with respect to 100 parts of the pigment crystal (weight ratio).

The processing temperature is 0° C. to the boiling point of the solvent, and preferably 10° C. to 60° C.

A grinding aid such as sodium chloride and Glauber's salt is used in the pulverization. The amount of the grinding aid is 0.5 times to 20 times, and preferably 1 time to 10 times that of the pigment.

The pigment crystal manufactured using a known method may be controlled using acid pasting or a combination of the acid pasting and the dry or wet pulverization described above. The acid for use in the acid pasting is preferably sulfuric acid at a concentration of 70% to 100%, and preferably 95% to 100%. The melting temperature is set to −20° C. to 100° C., and preferably 0° C. to 60° C. The amount of concentrated sulfuric acid is set to 1 time to 100 times, and preferably 3 times to 50 times that of the weight of the pigment crystal. Water or a mixed solvent of water and an organic solvent is used as a solvent for precipitation. The precipitation temperature is not particularly limited, but the pigment crystal is preferably cooled using ice or the like for prevention of heat generation.

The binder resin for use in the charge generation layer may be selected from a wide variety of insulating resins or from organic photoconductive polymers such as poly-N-vinylcarbazole, polyvinylanthracene, polyvinylpyrene, and polysilane.

Examples of the desirable binder resin include, but are not limited to, insulating resins such as a polyvinyl acetal resin, a polyarylate resin (polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, an urethane resin, an epoxy resin, casein, a polyvinyl alcohol resin, and a polyvinylpyrrolidone resin. These binder resins may be used singly or in a mixture of two or more types thereof. Among them, a polyvinyl acetal resin is particularly preferably used.

The blending ratio (weight ratio) of the charge generation material to the binder resin is preferably 10:1 to 1:10. A solvent for adjusting the coating liquid may be selected from known organic solvents such as alcohols, aromatic compounds, halogenated hydrocarbons, ketones, ketone alcohols, ethers, and esters. Specific examples thereof include normal organic solvents such as methanol, ethanol, n-propanol, isopropanol, n-butanol, benzyl alcohol, methylcellusolve, ethylcellusolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvents for use in the dispersion may be used singly or in a mixture of two or more types thereof. In mixing two or more types, any solvents may be used if the mixed solvent may dissolve the binder resin.

As a dispersing method, methods using a roll mill, a ball mill, a vibrating ball mill, an attritor, a sand mill, a colloid mill, and a paint shaker are used.

In the dispersion, particles having a particle size of 0.5 μm or less, preferably 0.3 μm or less, and more preferably 0.15 μm or less are effectively used.

Various additives may be added to the coating liquid for charge generation layer formation in order to improve the electric characteristics, image quality, and the like. Known materials are used as the additives, and examples thereof include electron transport materials including quinone compounds such as chloranil, bromanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, diphenoquinone compounds such as 3,3',5,5'-tetra-t-butyl diphenoquinone, electron transport pigments such as polycyclic condensed pigments and azo pigments, zirconium chelate compounds, titanium chelate compounds, aluminum chelate compounds, titanium alkoxide compounds, organic titanium compounds, and silane coupling agents.

Examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate.

Examples of the aluminum chelate compound include aluminum isopropylate, monobutoxyaluminum diisopropylate, aluminum butylate, diethylacetoacetate aluminum diisopropylate, and aluminum tris(ethylacetoacetate).

These compounds are used singly or as a mixture or polycondensate of plural compounds.

As a coating method that is used when providing the charge generation layer, normal methods such as a blade coating method, a wire bar coating method, a spray coating method, a dipping coating method, a bead coating method, an air knife coating method, and a curtain coating method are used.

The thickness of the charge generation layer is preferably set to 0.01 μm to 5 μm, and more preferably 0.05 μm to 2.0 μm.

Charge Transport Layer

The charge transport layer 6 is formed using a binder resin in which a charge transport material is dispersed.

Examples of the charge transport material that is used in this exemplary embodiment include hole transport substances such as oxadiazole derivatives such as 2,5-bis(p-diethyl aminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinyl carbazole and derivatives thereof; electron transport substances such as quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group containing any of the above compounds in the main or side chain.

In this exemplary embodiment, as the charge transport material, a compound having a butadiene structure expressed by the following Formula 2 is preferably used from the viewpoint of an improvement in charge transport ability for high speed and high image quality.

ture expressed by Formula 2 will be shown as follows. However, this exemplary embodiment is not limited to these compounds.

| Exemplary Compound No. | n2 | m1 | $R^1$ | $R^2$ | $R^3$ | $R^4$ | $R^5$ | $R^6$ |
|---|---|---|---|---|---|---|---|---|
| 2-1 | 1 | 0 | H | H | H | H | H | H |
| 2-2 | 1 | 0 | 4-Me | 4-Me | 4-Me | 4-Me | 4-Me | 4-Me |
| 2-3 | 1 | 0 | 4-Me | 4-Me | H | H | 4-Me | 4-Me |
| 2-4 | 1 | 0 | H | H | 4-Me | 4-Me | H | H |
| 2-5 | 1 | 0 | H | H | 3-Me | 3-Me | H | H |
| 2-6 | 1 | 0 | 4-Me | H | H | H | 4-Me | H |
| 2-7 | 1 | 0 | 4-MeO | H | H | H | 4-MeO | H |
| 2-8 | 1 | 0 | H | H | 4-MeO | 4-MeO | H | H |
| 2-9 | 1 | 0 | 4-MeO | H | 4-MeO | H | 4-MeO | 4-MeO |
| 2-10 | 1 | 0 | 3-Me | H | 3-Me | H | 3-Me | H |
| 2-11 | 1 | 1 | H | H | H | H | H | H |
| 2-12 | 1 | 1 | 4-Me | 4-Me | 4-Me | 4-Me | 4-Me | 4-Me |
| 2-13 | 1 | 1 | 4-Me | 4-Me | H | H | 4-Me | 4-Me |
| 2-14 | 1 | 1 | H | H | 4-Me | 4-Me | H | H |
| 2-15 | 1 | 1 | H | H | 3-Me | 3-Me | H | H |
| 2-16 | 1 | 1 | 4-Me | H | H | H | 4-Me | H |
| 2-17 | 1 | 1 | 4-MeO | H | H | H | 4-MeO | H |
| 2-18 | 1 | 1 | H | H | 4-MeO | 4-MeO | H | H |
| 2-19 | 1 | 1 | 4-MeO | H | 4-MeO | H | 4-MeO | 4-MeO |
| 2-20 | 1 | 1 | 3-Me | H | 3-Me | H | 3-Me | H |

Known resins may be used as the binder resin for use in the charge transport layer 6, but a resin formed as an electric Formula 2

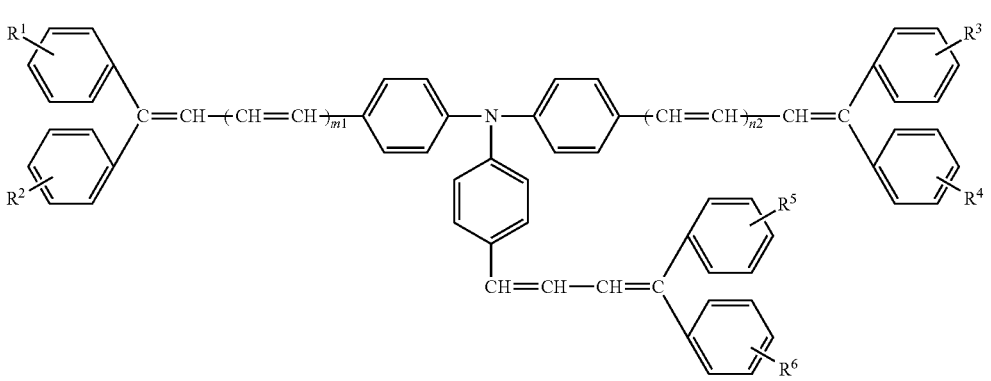

In Formula 2, $R^1$, $R^2$, $R^3$, $R^4$, $R^5$, and $R^6$ each may be the same as, or different from each other, and represent a hydrogen atom, an alkyl group, an alkoxy group, a halogen atom, or a substituted or unsubstituted aryl group. m1 and m2 represent 0 or 1.

The alkyl group preferably has 1 to 20 carbon atoms, and the alkoxy group preferably has 1 to 20 carbon atoms. Examples of the substituent group with which an aryl group may be substituted include a halogen atom, an alkoxy group, an alkyl group, and an aryl group.

In Formula 2, as $R^1$, $R^2$, $R^3$, $R^4$, $R^5$, and $R^6$, a hydrogen atom, an alkyl group, or an alkoxy group is preferable among the above, and a hydrogen atom, an alkyl group having 1 to 3 carbon atoms, or an alkoxy group having 1 to 3 carbon atoms is preferable. In addition, in Formula 2, m1 is preferably 1, and n2 is preferably 1.

Exemplary compounds 2-1 to 2-20 which are preferable specific examples of the compound having a butadiene strucinsulating film is desirable. Examples thereof include, but are not limited to, a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-carbazole, polyvinyl butyral, polyvinyl formal, polysulfone, casein, gelatin, polyvinyl alcohol, ethyl cellulose, a phenol resin, polyamide, carboxy-methyl cellulose, vinylidene chloride polymer wax, and polyurethane.

These binder resins may be used singly or in a mixture of two or more types thereof.

A polycarbonate copolymer that includes a repeating unit expressed by the following Formula 3 and a repeating unit expressed by the following Formula 4 is preferable as the binder resin for use in the charge transport layer 6.

Formula 3

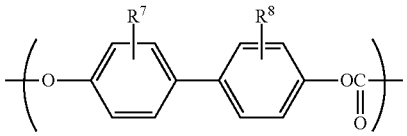

Formula 4

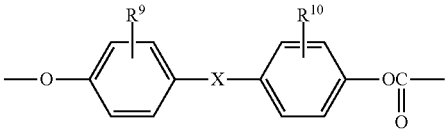

In Formulas 3 and 4, $R^7$, $R^8$, $R^9$, and $R^{10}$ each independently represent a hydrogen atom, a halogen atom, an alkyl group having from 1 to 6 carbon atoms, a cycloalkyl group having from 5 to 7 carbon atoms, or an aryl group having from 6 to 12 carbon atoms. X represents a phenylene group, a biphenylene group, a naphthylene group, a linear or branched alkylene group (preferably having from 1 to 12 carbon atoms), or a cycloalkylene group (preferably having from 3 to 12 carbon atoms).

As $R^7$, $R^8$, $R^9$, and $R^{10}$, a hydrogen atom, an alkyl group having from 1 to 6 carbon atoms, and an aryl group having from 6 to 12 carbon atoms are preferable, and a hydrogen atom, a methyl group, and a phenyl group are more preferable.

In formula 4, X is preferably a cycloalkylene group.

When the polycarbonate resin is a polycarbonate copolymer that includes a repeating unit expressed by the Formula 3 and a repeating unit expressed by the Formula 4, the content of the repeating unit expressed by the Formula 3 in the polycarbonate copolymer is, for example, 5 mol % to 95 mol %, preferably 5 mol % to 50 mol %, and more preferably 15 mol % to 25 mol %.

For the polycarbonate copolymer, for example, 4,4'-dihydroxybiphenyl compound is used as a raw material, and the polycarbonate copolymer is synthesized using a method such as polycondensation with a carbonate forming compound such as phosgene or a transesterification reaction with bisaryl carbonate.

The viscosity average molecular weight of the polycarbonate copolymer is, for example, 20,000 to 100,000, preferably 30,000 to 80,000, and more preferably 40,000 to 70,000.

The charge transport layer 6 may include fluorine particles.

Examples of the fluorine particles include particles of a fluorine resin, and examples of the fluorine resin include a tetrafluoroethylene resin, a trifluorochloroethylene resin, a hexafluoropropylene resin, a vinyl fluoride resin, a vinylidene fluoride resin, a difluorodichloroethylene resin, and copolymers thereof. Among them, a tetrafluoroethylene resin and a vinylidene fluoride resin are particularly preferable.

The primary particle diameter of the fluorine particles is, for example, 0.05 μm to 1 μm, and preferably 0.1 μm to 0.5 μm.

The content of the fluorine particles in the charge transport layer 6 is, for example, 2% by weight to 15% by weight.

Examples of the dispersing method for dispersing the fluorine particles in the coating liquid for charge transport layer formation include methods using a media disperser such as a ball mill, a vibrating ball mill, an attritor, and a sand mill, and a medialess disperser such as a stirrer, an ultrasonic disperser, a roll mill, a high-pressure homogenizer, and a nanomizer. Furthermore, examples of the high-pressure homogenizer include a collision-type homogenizer in which a dispersion is dispersed by liquid-liquid collision or liquid-wall collision under high pressure, and a penetration-type homogenizer in which a liquid is dispersed by allowing it to penetrate through a minute channel under high pressure.

As a dispersion stabilizer for the fluorine particles in the coating liquid, for example, fluorine-based surfactants and fluorine-based graft polymers may be used. Examples of the fluorine-based graft polymer include macromonomers including an acrylic ester compound, a methacrylic ester compound, a styrene compound, and the like, and resins graft-polymerized with perfluoroalkyl ethyl methacrylate.

The amount of the fluorine-based surfactant or fluorine-based graft polymer added is, for example, 1% by weight to 5% by weight with respect to the weight of the fluorine particles.

The appropriate thickness of the charge transport layer 6 is 5 μm to 50 μm, and preferably 10 μm to 35 μm.

As a coating method that is used when providing the charge transport layer, normal methods such as a blade coating method, a wire bar coating method, a spray coating method, a dipping coating method, a bead coating method, an air knife coating method, and a curtain coating method are used. As a solvent for use in the coating, normal organic solvents such as dioxane, tetrahydrofuran, methylene chloride, chloroform, chlorobenzene, and toluene are used singly or in a mixture of two or more types thereof.

Furthermore, in the electrophotographic photoreceptor of this exemplary embodiment, additives such as an antioxidant, a light stabilizer, and a heat stabilizer may be added to the photosensitive layer in order to prevent deterioration of the photoreceptor due to ozone and oxidizing gas or light and heat generated in the image forming apparatus.

Examples of the antioxidant include hindered phenols, hindered amines, paraphenylenediamine, arylalkanes, hydroquinone, spirochromane, spiroindanone, derivatives thereof, organic sulfur compounds, and organic phosphorous compounds.

Specific examples of the phenol-based antioxidant include 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl)propionyloxy]-1,1-dimethylethyl]-2,4,8,10-tetraoxaspiro[5,5]undecane. Examples of the hindered amine compound include bis(2,2,6,6-tetramethyl-4-piperidyl) sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-piperidyl) imino}nexamethylene{(2,3,6,6-tetramethyl-4-piperidyl) imino}], 2-(3,5-di-t-butyl-4-hydroxybenzyl)-2-n-butylmalonic acid bis(1,2,2,6,6-pentamethyl-4-piperidyl), and N,N'-bis(3-amino propyl)ethylenediamine-2,4-bis[N-butyl-N-(1,2,2,6,6,-pentamethyl-4-piperidyl)amino]-6-chloro-1,3,5-triazine condensate. Examples of the organosulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole. Examples of the organophosphorus antioxidant include trisnonylphenyl phosphite, triphenyl phosphite, and tris(2,4-di-t-butylphenyl)-phosphite.

The organosulfur antioxidant and the organophosphorus antioxidant are referred to as secondary antioxidants, and are used in combination with a primary antioxidant such as a phenol- or amine-based antioxidant to obtain a synergistic effect.

Examples of the light stabilizer include benzophenone derivatives, benzotriazole derivatives, dithiocarbamate derivatives, and tetramethylpiperidine derivatives.

Examples of the benzophenone light stabilizers include 2-hydroxy-4-methoxybenzophenone, 2-hydroxy-4-octoxybenzophenone, and 2,2'-di-hydroxy-4-methoxybenzophenone. Examples of the benzotriazole light stabilizers include 2-(-2'-hydroxy-5'-methylphenyl-)-benzotriazole, 2-[2'-hydroxy-3'-(3",4",5",6"-tetra-hydrophthalimide-methyl)-5'-methylphenyl]-benzotriazole, 2-(-2'-hydroxy-3'-t-butyl-5'-methylphenyl-)-5-chlorobenzotriazole, 2-(2'-hydroxy-3'-t-butyl-5'-methylphenyl-)-5-chlorobenzotriazole, 2-(2'-hydroxy-3',5'-t-butylphenyl-)-benzotriazole, 2-(2'-hydroxy-5'-t-octylphenyl)-benzotriazole, and 2-(2'-hydroxy-3',5'-di-t-amylphenyl-)-benzotriazole. Examples of compounds other than the above light stabilizers include 2,4-di-t-butylphenyl-3',5'-di-t-butyl-4'-hydroxybenzoate, and nickel dibutyldithiocarbamate.

At least one type of electron-accepting substance may be contained in the electrophotographic photoreceptor of this exemplary embodiment in order to improve the sensitivity and to reduce the residual potential and fatigue in repeated use. Examples of the electron-accepting substance for use in the photoreceptor of this exemplary embodiment include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, fluorenone derivatives, quinone derivatives, and benzene derivatives having an electron withdrawing substituent such as Cl, ON, and $NO_2$ are particularly preferable.

In addition, as a leveling agent for improving the smoothness of the coating film, silicone oil may be added to the coating liquid.

In the electrophotographic photoreceptor of this exemplary embodiment, a protective layer may be provided on the charge transport layer 6 as necessary. The protective layer is used to prevent a chemical change of the charge transport layer at the time of charging or to further improve the mechanical strength of the photosensitive layer. As the protective layer, known protective layers are used.

The appropriate thickness of the protective layer is 1 μm to 20 μm, and preferably 2 μm to 10 μm.

As a coating method that is used when providing the protective layer, normal methods such as a blade coating method, a wire bar coating method, a spray coating method, a dipping coating method, a bead coating method, an air knife coating method, and a curtain coating method are used.

As a solvent for use in the coating, normal organic solvents such as dioxane, tetrahydrofuran, methylene chloride, chloroform, chlorobenzene, and toluene are used singly or in a mixture of two or more types thereof. However, solvents that do not easily dissolve the lower layer are preferably used.

In the electrophotographic photoreceptor of this exemplary embodiment, the reflectance of incident light having a wavelength of 780 nm on the surface of the charge generation layer 5 when the charge transport layer 6 is removed is 17% or greater. When the reflectance is less than 17%, in some cases, the image history of the previous cycle causes an observable problem in image quality in the next image forming cycle. The reflectance is preferably 20% or greater.

As a method of manufacturing a reflectance measurement sample, there is a method including: laminating an undercoat layer, a charge generation layer, and a charge transport layer in this order on a conductive support to obtain an electrophotographic photoreceptor of this exemplary embodiment; and dipping the electrophotographic photoreceptor in an organic solvent such as toluene to dissolve and remove the charge transport layer. In addition, a sample in which an undercoat layer and a charge generation layer are laminated in this order on a conductive support may be used as a measurement target.

In this exemplary embodiment, the reflectance of incident light having a wavelength of 780 nm on the surface of the charge generation layer 5 is set to a predetermined value by adjusting, for example, the viscosity, coating speed, and drying conditions of the coating liquid for undercoat layer formation, and the viscosity and coating speed of the coating liquid for charge generation layer formation.

The viscosity of the coating liquid for undercoat layer formation is preferably 100 mPa·s to 300 mPa·s, and more preferably 150 mPa·s to 250 mPa·s at a coating temperature. The coating speed in the coating with the coating liquid for undercoat layer formation using a dipping coating method is preferably 100 mm/min to 300 mm/min, and more preferably 150 mm/min to 250 mm/min. Regarding the drying conditions after coating with the coating liquid for undercoat layer formation, the drying temperature is preferably 150° C. to 200° C., and more preferably 170° C. to 190° C. The drying time is preferably 15 minutes to 50 minutes, and more preferably 20 minutes to 40 minutes.

The viscosity of the coating liquid for charge generation layer formation is preferably 1.2 mPa·s to 2.5 mPa·s, and more preferably 1.4 mPa·s to 2.0 mPa·s at a coating temperature. The coating speed in the coating with the coating liquid for charge generation layer formation using a dipping coating method is preferably 30 mm/min to 200 mm/min, and more preferably 40 mm/min to 120 mm/min.

Further, the coating speed of a dipping coating method means a lift-up speed of lifting the dip coating in the coating liquid.

Next, an image forming apparatus and a process cartridge of this exemplary embodiment provided with the electrophotographic photoreceptor of this exemplary embodiment will be described.

Image Forming Apparatus

The image forming apparatus according to this exemplary embodiment include the electrophotographic photoreceptor according to this exemplary embodiment, a charging unit that charges a surface of the electrophotographic photoreceptor, an electrostatic latent image forming unit that exposes the charged surface of the electrophotographic photoreceptor to form an electrostatic latent image, a developing unit that develops the electrostatic latent image with a developer to form a toner image, and a transfer unit that transfers the toner image onto a transfer medium.

First Exemplary Embodiment

Figure 2:
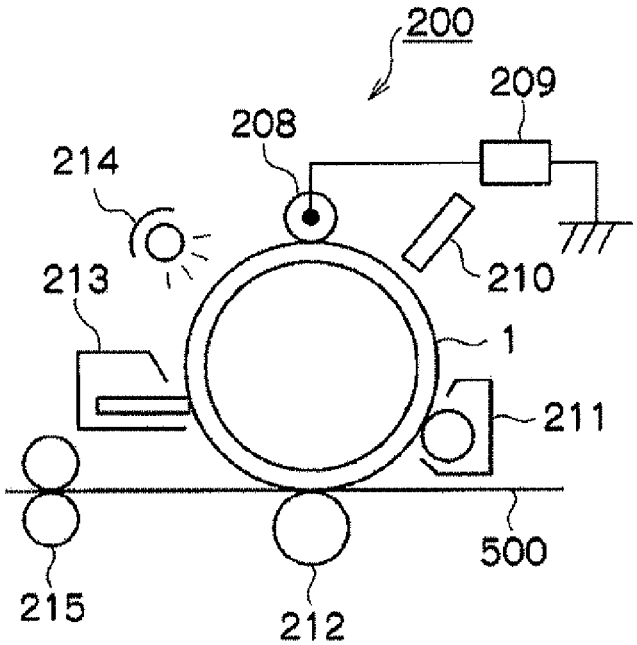
FIG. 2 is a schematic diagram showing the basic configuration of an image forming apparatus of a first exemplary embodiment.

FIG. 2 schematically shows the basic configuration of an image forming apparatus of a first exemplary embodiment. An image forming apparatus 200 shown in FIG. 2 is provided with an electrophotographic photoreceptor 1 of this exemplary embodiment, a contact charging-type charging device 208 that is connected to a power supply 209 to charge the electrophotographic photoreceptor 1, an electrostatic latent image forming device (exposure device) 210 that exposes the electrophotographic photoreceptor 1 charged using the charging device 208 to form an electrostatic latent image, a developing device 211 that develops the electrostatic latent image formed using the exposure device 210 with a developer including a toner to form a toner image, a transfer device 212 that transfers the toner image formed on the surface of the electrophotographic photoreceptor 1 onto a transfer medium 500, a toner removing device 213 that removes the toner remaining on the surface of the electrophotographic photoreceptor 1 after transferring, an erasing device 214 that eliminates the residual potential of the electrophotographic photoreceptor 1, and a fixing device 215 that fixes the toner image transferred onto the transfer medium 500. For example, there is no need to necessarily provide the erasing device 214. However, when the electrophotographic photoreceptor is repeatedly used, a phenomenon in which the residual potential of the electrophotographic photoreceptor is introduced to the next cycle is prevented, whereby image quality is increased.

In addition, when the electrophotographic photoreceptor of this exemplary embodiment is used, even in the case in which a cycle interval is short so that an interval during which the electrophotographic photoreceptor 1 passes through the charging device 208 after passing through the exposure device 210 is 240 msec or less, and an interval during which the electrophotographic photoreceptor 1 passes through the charging device 208 after passing through the erasing device 214 is 35 msec or less, the image forming history of the previous cycle does not easily remain in the next cycle.

The charging device 208 has a charging roll that is a contact-type charging unit, and a voltage is applied to the charging roll when charging the electrophotographic photoreceptor 1. Regarding the range of the voltage, a DC voltage is preferably 650 V or greater, and more preferably 700 V or greater in terms of absolute value in accordance with the required photoreceptor charging potential. In addition, the DC voltage is preferably 1,500 V or less.

Since the contact-type charging unit goes through processes such as electric discharge caused by a micro-gap immediately before contact at the time of charging, charge exchange in a contact portion, and electric discharge caused by a micro-gap after passing through the contact portion, the image forming history of the previous cycle easily remains in the next cycle due to the reason that the interior electric field of the photoreceptor is easily distorted. However, when the electrophotographic photoreceptor of this exemplary embodiment is used, the working history does not easily remain in the next cycle.

In addition, in the case of the contact-type charging unit, the charging potential is not easily raised in comparison to the case of a noncontact-type charging unit, and when the charging potential is set to be high, that is, 650 V or greater in terms of absolute value, it is difficult to uniformly charge the surface of the electrophotographic photoreceptor and the working history easily remains in the next cycle in some cases. However, when the electrophotographic photoreceptor of this exemplary embodiment is used, the working history does not easily remain in the next cycle even when the charging potential by the contact-type charging unit is high, that is, 650 V or greater in terms of absolute value.

In addition, when superimposing an AC voltage in charging of the electrophotographic photoreceptor 1, the voltage between peaks is 400 V to 1,800 V, preferably 800 V to 1,600 V, and more preferably 1,200 V to 1,600 V. The frequency of the AC voltage is 50 Hz to 20,000 Hz, and preferably 100 Hz to 5,000 Hz.

Regarding the charging roll, a charging roll that has an elastic layer, a resistive layer, a protective layer, and the like provided on the outer peripheral surface of a core is preferably used. Even when the charging roll does not have a particular driving unit, it is brought into contact with the photoreceptor 1 to rotate with the rotation of the photoreceptor 1 to thereby function as a charging unit. However, a driving unit may be attached to the charging roll to rotate the charging roll at a peripheral speed different from that of the photoreceptor 1 to thereby charge the photoreceptor 1. The applied voltage may be any of a DC voltage and a DC voltage on which an AC voltage is superimposed.

As the exposure device 210, optical devices and the like that expose the surface of the electrophotographic photoreceptor in accordance with a desired image using a light source such as semiconductor laser, light emitting diode (LED), and liquid crystal shutter are used.

As the developing device 211, known developing devices and the like utilizing a normal or reversal developer such as a single-component-type developer and a two-component-type developer are used. The shape of the toner for use in the developing device 211 is not particularly limited, and a toner having an amorphous shape, a spherical shape, or another particular shape may be used.

Examples of the transfer device 212 include, other than roller-like contact-type charging members, contact-type transfer charging units using a belt, a film, a rubber plate and the like, and scorotron transfer charging units and scorotron transfer charging units using corona discharge.

The toner removing device 213 is used to remove the residual toner attached to the surface of the electrophotographic photoreceptor 1 after the transferring process. The electrophotographic photoreceptor 1, the surface of which has been cleaned therewith, is repeatedly used for the image forming process. As the toner removing device 213, other than a foreign substance removing member (cleaning blade), a cleaning brush, a cleaning roll, and the like are used. Among them, a cleaning blade is preferably used. Examples of a material of the cleaning blade include urethane rubber, neoprene rubber, and silicone rubber.

Second Exemplary Embodiment

Figure 3:
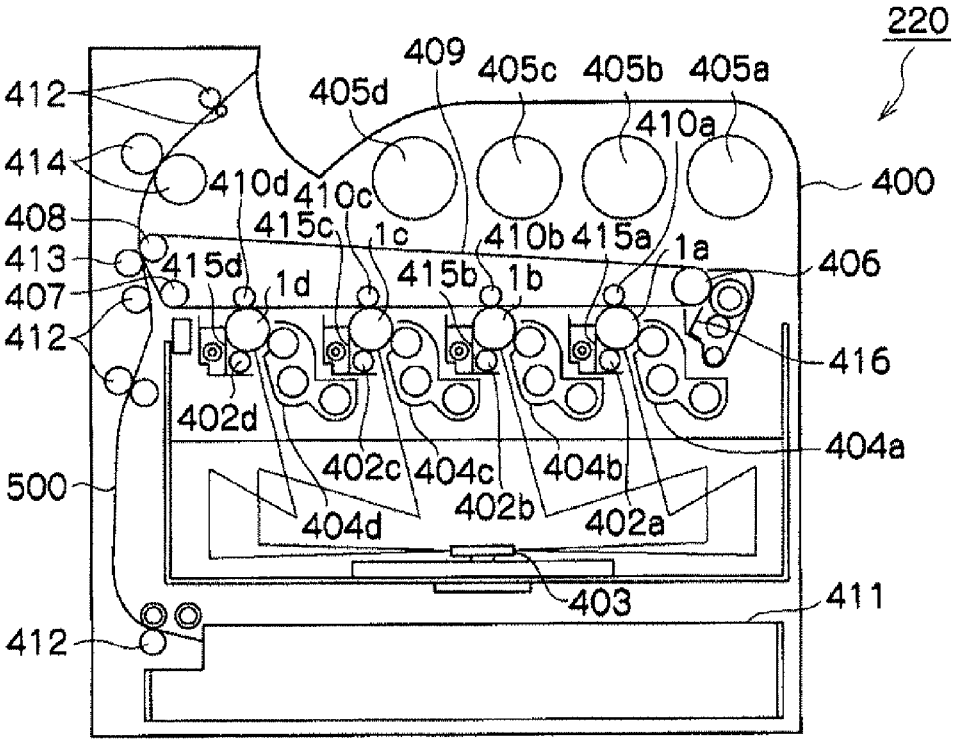
FIG. 3 is a schematic diagram showing the basic configuration of an image forming apparatus of a second exemplary embodiment.

FIG. 3 schematically shows the basic configuration of an image forming apparatus of a second exemplary embodiment. An image forming apparatus 220 shown in FIG. 3 is an intermediate transfer-type image forming apparatus, and in a housing 400, four electrophotographic photoreceptors 1*a*, 1*b*, 1*c*, and 1*d* are arranged in parallel along an intermediate transfer belt 409. For example, the photoreceptor 1*a* forms a yellow image, the photoreceptor 1*b* forms a magenta image, the photoreceptor 1*c* forms a cyan image, and the photoreceptor 1*d* forms a black image.

Here, the electrophotographic photoreceptors 1*a*, 1*b*, 1*c*, and 1*d* mounted on the image forming apparatus 220 are electrophotographic photoreceptors of this exemplary embodiment.

Each of the electrophotographic photoreceptors 1*a*, 1*b*, 1*c*, and 1*d* rotates in one direction (counterclockwise direction on paper), and in the rotation direction, charging rolls 402*a*, 402*b*, 402*c*, and 402*d*, developing devices 404*a*, 404*b*, 404*c*, and 404*d*, primary transfer rolls 410*a*, 410*b*, 410*c*, and 410*d*, and cleaning blades 415*a*, 415*b*, 415*c*, and 415*d* are arranged. The developing devices 404*a*, 404*b*, 404*c*, and 404*d* supply four color toners, that is, a yellow toner, a magenta toner, a cyan toner, and a black toner accommodated in toner cartridges 405*a*, 405*b*, 405*c*, and 405*d*, respectively, and the primary transfer rolls 410*a*, 410*b*, 410*c*, and 410*d* are connected to the electrophotographic photoreceptors 1*a*, 1*b*, 1*c*, and 1*d* via the intermediate transfer belt 409, respectively.

Furthermore, a laser light source (exposure device) 403 is disposed inside the housing 400, and surfaces of the electrophotographic photoreceptors 1*a*, 1*b*, 1*c*, and 1*d* are irradiated with the laser light emitted from the laser light source 403 after charging. Accordingly, in the rotation process of the electrophotographic photoreceptors 1*a*, 1*b*, 1*c*, and 1*d*, charging, exposure, developing, primary transferring, and cleaning (removing foreign substance such as toner) processes are sequentially performed, and toner images of the respective colors are transferred and superimposed on the intermediate transfer belt 409. The intermediate transfer belt 409 is supported with tension by a driving roll 406, a rear surface roll 408, and a support roll 407, and rotates by the rotation of the rolls without the occurrence of bending. In addition, a secondary transfer roll 413 is disposed to be brought into contact with the rear surface roll 408 via the intermediate transfer belt 409. The surface of the intermediate transfer belt 409 passing between the rear surface roll 408 and the secondary transfer roll 413 is cleaned with, for example, a cleaning blade 416 disposed in the vicinity of the driving roll 406, and then the intermediate transfer belt 409 is repeatedly used for the next image forming process.

In addition, a container 411 accommodating a transfer medium is provided inside the housing 400. The transfer medium 500 such as paper in the container 411 is sequentially transported between the intermediate transfer belt 409 and the secondary transfer roll 413 and further between two fixing rolls 414 brought into contact with each other by the use of a transport roll 412, and then is discharged to the outside of the housing 400.

In the above description, the case has been described in which the intermediate transfer belt 409 is used as an intermediate transfer member, but the intermediate transfer member may have a belt shape as in the case of the above intermediate transfer belt 409, or a drum shape. In the case of a belt shape, known resins are used as a resin material constituting a base material of the intermediate transfer member. Examples thereof include resin materials such as a polyimide resin, a polycarbonate resin (PC), polyvinylidene fluoride (PVDF), polyalkylene terephthalate (PAT), blends such as ethylene tetrafluoroethylene copolymer (ETFE)/PC, ETFE/PAT and PC/PAT, polyester, polyether ether ketone, and polyamide, and resin materials made with these as a main material. Furthermore, a resin material and an elastic material may be blended and used.

In addition, the transfer medium according to the exemplary embodiments is not particularly limited as long as it is a medium onto which a toner image formed on the electrophotographic photoreceptor is transferred. For example, when transferring is directly performed on a transfer medium such as paper from the electrophotographic photoreceptor 1 as in the first exemplary embodiment shown in FIG. 2, the paper and the like is a transfer medium. In addition, when an intermediate transfer member is used as in the second exemplary embodiment shown in FIG. 3, the intermediate transfer member is a transfer medium.

In the image forming apparatuses 200 and 220 that are provided with the electrophotographic photoreceptor 1 of this exemplary embodiment as described above, the image forming history of the previous cycle does not easily remain in the next cycle.

Process Cartridge

Figure 4:
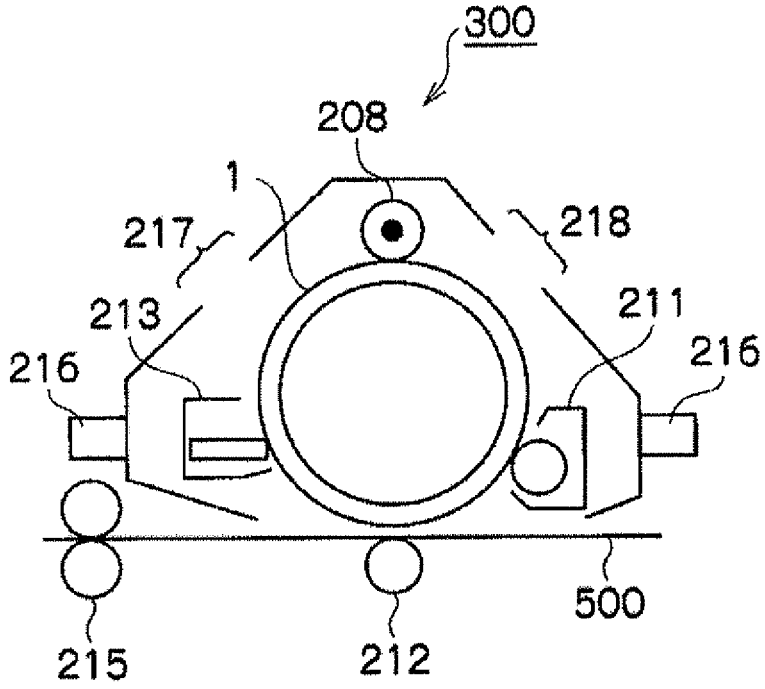
FIG. 4 is a schematic diagram showing the basic configuration of an example of a process cartridge.

FIG. 4 schematically shows the basic configuration of an example of a process cartridge provided with the electrophotographic photoreceptor of this exemplary embodiment. In the process cartridge 300, the electrophotographic photoreceptor 1 is combined with the charging device 208, the developing device 211, the toner removing device 213, an opening portion 218 for exposure, and an opening portion 217 for erasing exposure to be integral therewith by the use of an attachment rail 216.

The process cartridge 300 is detachably mounted on an image forming apparatus body formed of the transfer device 212, the fixing device 215, and other constituent parts (not shown), and constitutes an image forming apparatus with the image forming apparatus body.

In the process cartridge 300 that is provided with the electrophotographic photoreceptor of this exemplary embodiment as described above, the image forming history of the previous cycle does not easily remain in the next cycle.

Examples

Hereinafter, this exemplary embodiment will be described in more detail on the basis of examples and comparative examples, but is not limited to the following examples.

Example 1

100 parts by weight of zinc oxide (average particle diameter: 70 nm, manufactured by Tayca Corporation, specific surface area value: 15 $m^2/g$) and 500 parts by weight of methanol are stirred and mixed, and as a silane coupling agent, 0.75 part by weight of KBM603 (manufactured by Shin-Etsu Chemical Co., Ltd.) is added thereto and the resulting mixture is stirred for 2 hours. Thereafter, the methanol is distilled away by distillation under reduced pressure and baking is performed for 3 hours at 120° C. to obtain zinc oxide particles surface-treated with the silane coupling agent.

38 parts by weight of a solution obtained by dissolving 60 parts by weight of the surface-treated zinc oxide particles, 1.2 parts by weight of the specific example 1-6 of the above specific reactive acceptor substance, 13.5 parts by weight of blocked isocyanate (SUMIDUR 3173, manufactured by Sumitomo Bayer Urethane Co., Ltd) as a curing agent, and 15 parts by weight of a butyral resin (S-LEC BM-1, manufactured by Sekisui Chemical Co., Ltd.) in 85 parts by weight of methyl ethyl ketone, and 25 parts by weight of methyl ethyl ketone are mixed and dispersed with a sand mill using glass beads having a diameter of 1 mm for 4 hours to obtain a dispersion. To the obtained dispersion, 0.005 part by weight of dioctyltin dilaurate as a catalyst and 4.0 parts by weight of silicone resin particles (TOSPEARL 145, manufactured by GE Toshiba Silicones Co., Ltd.) are added, thereby obtaining a coating liquid for undercoat layer formation. The viscosity of the coating liquid for undercoat layer formation at a coating temperature (24° C.) is 235 mPa·s.

The coating liquid is applied to an aluminum base material having a diameter of 30 mm at a coating speed of 220 mm/min using a dipping coating method, and then dried and cured for 40 minutes at 180° C. to obtain an undercoat layer having a thickness of 25 μm.

Next, a mixture of 15 parts by weight of a hydroxygallium phthalocyanine crystal as a charge generation material having strong diffraction peaks at least at Bragg angles (2θ±0.2°) of 7.5°, 9.9°, 12.5°, 16.3°, 18.6°, 25.1°, and 28.3° with respect to CuKα characteristic X-rays, 10 parts by weight of a copolymer resin of vinyl chloride-vinyl acetate (VMCH, manufactured by Nippon Unicar Company Ltd.), and 300 parts by weight of n-butyl alcohol is dispersed with a sand mill using glass beads having a diameter of 1 mm for 4 hours to obtain a coating liquid for charge generation layer formation. The viscosity of the coating liquid for charge generation layer formation at a coating temperature (24° C.) is 1.8 mPa·s. The undercoat layer is dipped in and coated with this coating liquid using a dipping coating method at a coating speed of 65 mm/min, and drying is performed for 10 minutes at 150° C., thereby obtaining a charge generation layer.

Next, 8 parts by weight of tetrafluoroethylene resin particles (average particle diameter: 0.2 μm) and 0.01 part by weight of a methacrylic copolymer containing an alkyl fluoride group (weight average molecular weight: 30,000) are kept at a liquid temperature of 20° C. together with 4 parts by weight of tetrahydrofuran and 1 part by weight of toluene, and are stirred and mixed for 48 hours to obtain a tetrafluoroethylene resin particle suspension A.

Next, 4 parts by weight of a compound (in Formula 2, n2=1, m1=1, $R^1$, $R^2$, $R^3$, $R^4$, $R^5$, and $R^6$ all are H, tris[4-(4,4-diphenyl-1,3-butadienyl)phenyl]amine) as a charge transport substance expressed by the following Structural Formula 1, 6 parts by weight of a polycarbonate copolymer (viscosity average molecular weight: 40,000) as a binder resin having a repeating unit expressed by the following Structural Formula 2 and a repeating unit expressed by the following Structural Formula 3, and 0.1 part by weight of 2,6-di-t-butyl-4-methylphenol as an antioxidant are mixed, and 24 parts by weight of tetrahydrofuran and 11 parts by weight of toluene are mixed and dissolved to obtain a mixed solution B.

The liquid A is added to, and stirred and mixed with the liquid B, and then the resultant material is repeatedly subjected to dispersion 6 times under pressure increased to 500 kgf/cm$^2$ by the use of a high-pressure homogenizer (manufactured by Yoshida Kikai Co., Ltd.) mounted with a penetration-type chamber having a minute channel, and 5 ppm of fluorine-modified silicone oil (trade name: FL-100, manufactured by Shin-Etsu Chemical Co., Ltd.) is added thereto and sufficiently stirred to obtain a coating liquid for charge transport layer formation. The charge generation layer is coated with this coating liquid so that the thickness of the coating liquid is 24 μm, and drying is performed at 135° C. for 25 minutes to form a charge transport layer, thereby obtaining an intended electrophotographic photoreceptor. The electrophotographic photoreceptor obtained in this manner is set as a photoreceptor 1.

Structural Formula 1

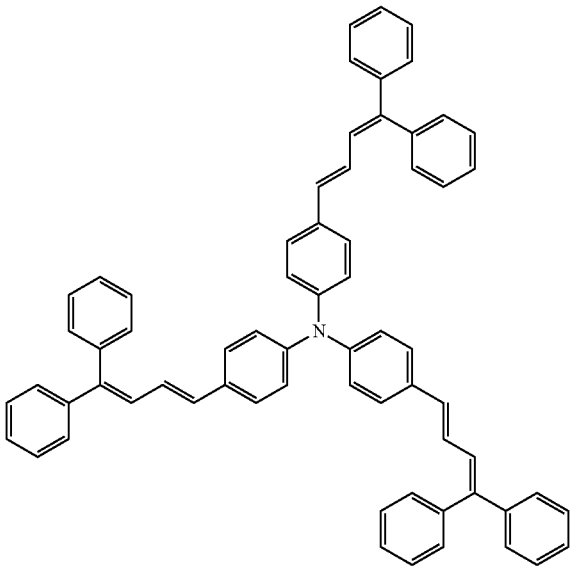

-continued

Structural Formula 2

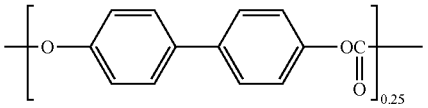

Structural Formula 3

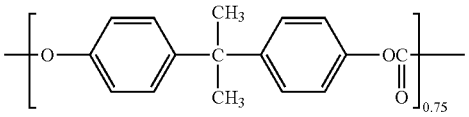

Evaluation

Using the photoreceptor 1, the following evaluation is carried out.

Ghosting

Regarding ghosting evaluation, a modification of a DocuPrint 505 (manufactured by Fuji Xerox Co., Ltd.) (image forming apparatus having the configuration shown in FIG. 2) having the photoreceptor 1 installed therein continuously prints a chart having an image density of 100% with a 2 mm width on 2,000 sheets of paper under a 28° C.-85 RH % atmosphere, and a full half-tone image having an image density of 30% is printed immediately afterward. The change in density on the print is visually perceived for evaluation. The evaluation standard is as follows. The obtained results are shown in Table 1.

The charging unit of the DocuPrint 505 is a contact-type charging unit, and the charging potential is adjusted to −650 V.

A: No change in density.

B: Level having no problem in practical use although a slight change in density may be recognized.

C: Level having a problem in practical use because there is a slight change in density.

D: Level having a problem in practical use because there is a noticeable change in density.

Residual Potential

Regarding residual potential (V) evaluation, a modification of a DocuPrint 505 (manufactured by Fuji Xerox Co., Ltd.) having the photoreceptor 1 installed therein continuously prints a random chart having an image density of 5% on 50,000 sheets of paper under a 28° C.-85 RH % atmosphere. Immediately after that, a surface potential probe is installed between the charging device 208 and the exposure device 210, and measurement is performed for evaluation by the use of a surface electrometer TREK 334 (manufactured by TREK Co.). The obtained results are shown in Table 1.

Reflectance

Regarding reflectance (%) evaluation, a drum having an undercoat layer and a charge generation layer formed thereon is irradiated with light using a halogen lamp, and the intensity of light rays having a wavelength of 780 nm among the reflected light rays is measured for evaluation by the use of a spectrophotometer (MPCD-3000, manufactured by Otsuka Electronics Co., Ltd.) at 24 points in a peripheral direction of the drum and at 10 points in an axial direction. The obtained results are shown in Table 1.

Example 2

A photoreceptor 2 is made in the same manner as in Example 1, except that 3.3 parts by weight of the specific example 1-6 of the specific reactive acceptor substance is used, and is evaluated in the same manner as in Example 1.

The obtained results are shown in Table 1.

Example 3

A photoreceptor 3 is manufactured in the same manner as in Example 1, except that the drying temperature for the undercoat layer is 185° C., and the coating speed for the charge generation layer is 55 mm/min, and is evaluated in the same manner as in Example 1.

The obtained results are shown in Table 1.

Example 4

A photoreceptor 4 is manufactured in the same manner as in Example 1, except that as a charge transport material, 4 parts by weight of N,N'-diphenyl-N,N'-bis(3-methylphenyl)-[1,1']biphenyl-4,4'-diamine is used, and is evaluated in the same manner as in Example 1.

The obtained results are shown in Table 1.

Example 5

A configuration that is the same as that of Example 1, except that an insulating resin collar is mounted on an end portion of the charging roll and a gap between the photoreceptor and the charging roll is adjusted to 50 μm to perform noncontact charging, is set as Example 5, and is evaluated in the same manner as in Example 1.

The obtained results are shown in Table 1.

Example 6

Evaluation is performed as in Example 1, except that the charging potential is adjusted to −630 V.

The obtained results are shown in Table 1.

Comparative Example 1

A photoreceptor C1 is manufactured in the same manner as in Example 1, except that the drying temperature for the undercoat layer is 195° C., and the coating speed for the charge generation layer is 140 mm/min, and is evaluated in the same manner as in Example 1.

The obtained results are shown in Table 1.

Comparative Example 2

A photoreceptor C2 is manufactured in the same manner as in Example 1, except that the drying temperature for the undercoat layer is 192.5° C., and the coating speed for the charge generation layer is 80 mm/min, and is evaluated in the same manner as in Example 1.

The obtained results are shown in Table 1.

Comparative Example 3

100 parts by weight of zinc oxide (average particle diameter: 70 nm, manufactured by Tayca Corporation, specific surface area value: 15 $m^2/g$) and 500 parts by weight of methanol are stirred and mixed, and as a silane coupling agent, 0.75 part by weight of KBM603 (manufactured by Shin-Etsu Chemical Co., Ltd.) is added thereto and the resulting mixture is stirred for 2 hours. Thereafter, the methanol is distilled away by distillation under reduced pressure and baking is performed for 3 hours at 120° C. to obtain zinc oxide particles surface-treated with the silane coupling agent.

38 parts by weight of a solution obtained by dissolving 60 parts by weight of the surface-treated zinc oxide particles, 13.5 parts by weight of blocked isocyanate (SUMIDUR 3173, manufactured by Sumitomo Bayer Urethane Co., Ltd) as a curing agent, and 15 parts by weight of a butyral resin (S-LEC BM-1, manufactured by Sekisui Chemical Co., Ltd.) in 85 parts by weight of methyl ethyl ketone, and 25 parts by weight of methyl ethyl ketone are mixed and dispersed with a sand mill using glass beads having a diameter of 1 mm for 4 hours to obtain a dispersion. To the obtained dispersion, 0.005 part by weight of dioctyltin dilaurate as a catalyst and 4.0 parts by weight of silicone resin particles (TOSPEARL 145, manufactured by GE Toshiba Silicones Co., Ltd.) are added, thereby obtaining a coating liquid for undercoat layer formation. A photoreceptor C3 is manufactured in the same manner as in Example 1, except that after the coating liquid is obtained, the coating liquid is left in the air to volatilize the solvent, whereby the viscosity of the coating liquid for undercoat layer formation at a coating temperature (24° C.) is 235 mPa·s, and is evaluated in the same manner as in Example 1.

The obtained results are shown in Table 1.

Comparative Example 4

A photoreceptor C4 is manufactured in the same manner as in Example 1, except that as a reactive acceptor substance, 0.5 parts by weight of a tris-bipyridineruthenium complex (manufactured by Aldrich) is used in the undercoat layer, and is evaluated in the same manner as in Example 1.

The obtained results are shown in Table 1.

Comparative Example 5

A photoreceptor C5 is manufactured in the same manner as in Example 1, except that as a charge generation material, 15 parts by weight of a chlorogallium phthalocyanine crystal having strong diffraction peaks at least at Bragg angles (2θ±0.2°) of 7.4°, 16.6°, 25.5°, and 28.3° with respect to CuKα characteristic X-rays is used, and is evaluated in the same manner as in Example 1.

The obtained results are shown in Table 1.

In Table 1, an elapsed time between exposure and primary charging with a charging device, an elapsed time between erasing and primary charging with a charging device, and charging potential are also tabulated.

TABLE 1

| | Reflectance (%) | Elapsed Time Between Exposure and Primary Charging (msec) | Elapsed Time Between Erasing and Primary Charging (msec) | Charging Potential (−V) | Ghosting | Residual Potential (−V) |
|---|---|---|---|---|---|---|
| Example 1 | 17 | 235 | 30 | 650 | A | 40 |
| Example 2 | 17 | 235 | 30 | 665 | A | 25 |
| Example 3 | 20 | 210 | 27 | 875 | A | 30 |
| Example 4 | 17 | 235 | 30 | 635 | A | 65 |
| Example 5 | 17 | 235 | 30 | 635 | A | 45 |
| Example 6 | 17 | 235 | 47 | 630 | B | 100 |
| Comparative Example 1 | 10 | 235 | 30 | 650 | D | 50 |
| Comparative Example 2 | 15 | 338 | 47 | 660 | D | 40 |
| Comparative Example 3 | 12 | 235 | 30 | 650 | D | 60 |
| Comparative Example 4 | 10 | 235 | 30 | 650 | D | 100 |
| Comparative Example 5 | 10 | 235 | 30 | 650 | C | 200 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive support; and an undercoat layer, a charge generation layer, and a charge transport layer that are provided in this order on the conductive support, wherein the undercoat layer includes at least metallic oxide particles, a reactive acceptor substance including an anthraquinone structure expressed by the following Formula 1, and a binder resin, the charge generation layer includes hydroxygallium phthalocyanine as a charge generation material formed at a dip coating speed between 55 mm/min and 65 mm/min, and a reflectance of incident light having a wavelength of 780 nm on a surface of the charge generation layer when the charge transport layer is removed is 17% or greater:

Formula 1

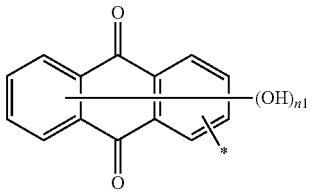

wherein the anthraquinone structure expressed by Formula 1 is bonded to another structure at a position of *, and thus forms the reactive acceptor substance, and in Formula 1, n1 represents an integer of from 1 to 7, and wherein in the Formula 1, the another structure bonded at the position of * is an alkoxy group.

2. The electrophotographic photoreceptor according to claim 1, wherein the reflectance is 20% or greater.

3. The electrophotographic photoreceptor according to claim 1, wherein in the Formula 1, n1 is 1 to 4.

4. The electrophotographic photoreceptor according to claim 1, wherein in the Formula 1, another structure bonded at the position of * is an alkoxy group having from 1 to 8 carbon atoms.

5. The electrophotographic photoreceptor according to claim 1, wherein an amount of the reactive acceptor substance added of the Formula 1 is 0.1% by weight to 10% by weight in the undercoat layer.

6. The electrophotographic photoreceptor according to claim 1, wherein an amount of the reactive acceptor substance added of the Formula 1 is 0.5% by weight to 5% by weight in the undercoat layer.

7. The electrophotographic photoreceptor according to claim 1, wherein the charge transport layer includes a compound that has a charge transport ability and has a butadiene structure expressed by the following Formula 2, and a polycarbonate copolymer including a repeating unit expressed by the following Formula 3 and a repeating unit expressed by the following Formula 4:

Formula 2

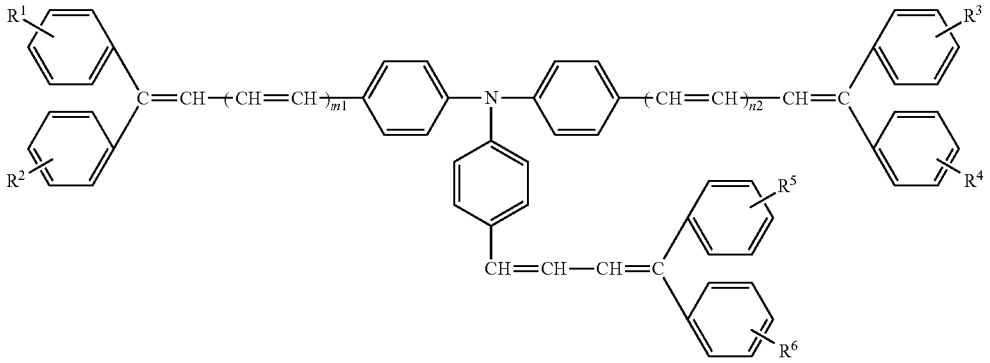

wherein in Formula 2, $R^1$, $R^2$, $R^3$, $R^4$, $R^5$, and $R^6$ each may be the same as, or different from each other, and represent a hydrogen atom, an alkyl group, an alkoxy group, a halogen atom, or a substituted or unsubstituted aryl group, and m1 and n2 represent 0 or 1;

Formula 3

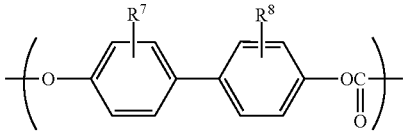

Formula 4

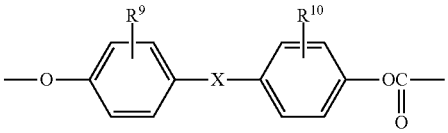

wherein in Formulas 3 and 4, $R^7$, $R^8$, $R^9$, and $R^{10}$ each independently represent a hydrogen atom, a halogen atom, an alkyl group having 1 to 6 carbon atoms, a cycloalkyl group having 5 to 7 carbon atoms, or an aryl group having 6 to 12 carbon atoms, and X represents a phenylene group, a biphenylene group, a naphthylene group, a linear or branched alkylene group, or a cycloalkylene group.

8. The electrophotographic photoreceptor according to claim 7, wherein in the Formula 2, m1 and n2 are 1.

9. The electrophotographic photoreceptor according to claim 7, wherein in the Formula 4, X is a cycloalkylene group.

10. A process cartridge comprising:

the electrophotographic photoreceptor according to claim 1; and at least one selected from the group consisting of a charging unit that charges a surface of the electrophotographic photoreceptor, a developing unit that develops an electrostatic latent image formed on the electrophotographic photoreceptor with a developer to form a toner image, and a toner removing unit that removes a toner remaining on the surface of the electrophotographic photoreceptor.

11. An image forming apparatus comprising:

the electrophotographic photoreceptor according to claim 1;

a charging unit that charges a surface of the electrophotographic photoreceptor;

an electrostatic latent image forming unit that exposes the charged surface of the electrophotographic photoreceptor to form an electrostatic latent image;

a developing unit that develops the electrostatic latent image with a developer to form a toner image; and a transfer unit that transfers the toner image onto a transfer medium.

12. The image forming apparatus according to claim 11, wherein the charging unit is a contact-type charging unit.

13. The image forming apparatus according to claim 11, wherein the charging potential by the contact-type charging unit is 650 V or greater in terms of absolute value.

14. The image forming apparatus according to claim 11, wherein the charging potential by the contact-type charging unit is 700 V or greater in terms of absolute value.

* * * * *